US005575227A

United States Patent [19]

Papajewski et al.

[11] Patent Number: 5,575,227

[45] Date of Patent: Nov. 19, 1996

[54] FEED MECHANISM FOR A BUTTONHOLE SEWING MACHINE

[75] Inventors: Rudy Papajewski; Gerd Papajewski, both of Stutensee, Germany

[73] Assignee: AMF Reece, Inc., Mechanicsville, Va.

[21] Appl. No.: 520,645

[22] Filed: Aug. 29, 1995

[51] Int. Cl.[6] ..... D05B 3/06

[52] U.S. Cl. ..... 112/76; 112/311; 112/475.25

[58] Field of Search ..... 112/65, 67, 70, 112/72, 73, 76, 311, 316, 317, 312, 315, 323, 475.25

[56] References Cited

U.S. PATENT DOCUMENTS

| | | | |
|---|---|---|---|
| 976,431 | 11/1910 | Boyler | 112/76 X |
| 1,461,040 | 7/1923 | Lindner | 112/70 |
| 2,619,925 | 12/1952 | Sharenow et al. | 112/77 |
| 3,033,136 | 5/1962 | Nickerson et al. | 112/77 |
| 3,127,856 | 4/1964 | Taketomi | 112/77 |
| 3,313,255 | 4/1967 | Rausch et al. | 112/470.01 |
| 4,425,860 | 1/1984 | Landwehr et al. | 112/311 |
| 4,512,273 | 4/1985 | Skogward | 112/315 |
| 4,762,077 | 8/1988 | Skogward | 112/323 |

*Primary Examiner*—Ismael Izaguirre
*Attorney, Agent, or Firm*—James Creighton Wray

[57] ABSTRACT

A feed mechanism for a buttonhole sewing machine has a movable plate with a clamped piece of cloth. A rack is formed on a rearward extension of the plate. A pinion engages the rack, and a large gear is fixed to the pinion. An upper driving gear drives the large gear and is fixed to a vertical stub shaft which extends through the base of the sewing machine. A lower driving gear is mounted on the lower end of the vertical stub shaft beneath the work-supporting surface. A longitudinally shiftable horizontal shaft is mounted beneath the vertical stub shaft. A left bevel gear and a right bevel gear are keyed to the shiftable shaft. The shaft may be shifted so that either one or the other bevel gear engages the gear on the vertical stub shaft, or to an intermediate position in which the bevel gears are disengaged. The horizontal shaft is driven by a ratchet mechanism. In operation, the horizontal shaft is shifted so that the right bevel gear drives the lower driving gear and bight stitches are formed along a first side of a buttonhole. The bevel gears are disengaged and tack stitches are made at the second end of the buttonhole. The left bevel gear engages the lower driving gear, moving the plate and feeding the cloth back while bight stitches are made along the second side of the buttonhole. The bevel gears are disengaged for forming tack stitches at the first end of the buttonhole.

20 Claims, 4 Drawing Sheets

FEED MECHANISM FOR A BUTTONHOLE SEWING MACHINE

BACKGROUND OF THE INVENTION

This invention relates to a feeding mechanism positioned in the base of a buttonhole sewing machine for advancing, dwelling and reversing material in which a buttonhole is formed.

Modern sewing machines have automatic controls for positioning and sewing cloth. Large scale production of shirts and other articles of clothing has created needs for industrial sewing machines that do not sacrifice high quality and precision for speed.

Industrial sewing machines need to operate at a rapid pace for extended periods of time. Down time due to part failure or repair must be minimized. Machines having only a few parts are preferred over machines with greater numbers of parts because the occurrence of breakdown decreases as the number of parts decreases. Simpler designs require lower maintenance. Sewing machines for factory use must also have designs that facilitate access. Needs exist for machines that allow for easy access. Efficiency and productivity mandate that multiple components of a single mechanism be positioned and connected in one easily accessible unit.

Sewing buttonholes into a shirt requires precision. Industrial sewing machines need feeding mechanisms that operate in forward, reverse and neutral feed positions to make appropriate buttonhole stitches quickly. The cloth must be firmly held to a plate capable of moving quickly and consistently. Buttonhole stitching needs to be automatic and precise and needs to require no human intervention or else productivity is sacrificed.

For industrial applications, sewing machines need to operate at high speeds. Mechanisms for rotating and positioning cloth need to be compatible with modern sewing machines to realize the benefits of existing technology that has created needles capable of high speed stitching.

Existing sewing machines need fast, precise, two-dimensional feeding mechanisms that are demanded for the mass production of shirts and other articles of clothing requiring buttonholes. Needs have long existed for low maintenance, highly efficient feeding mechanisms for automatic industrial sewing machines.

SUMMARY OF THE INVENTION

The present invention relates to a feeding mechanism that can be incorporated in an industrial buttonhole sewing machine. The mechanism is capable of functioning at high speeds and sews high quality buttonholes without manual intervention, rotation of the fabric or redirectioning of the needle.

The feeding mechanism has a simple structure and function. An operator places a shirt on a plate positioned on the base of the sewing machine. When the floor pedal is depressed, the clamping mechanism clamps the shirt to the plate and the feeding mechanism moves the plate in a constant step motion in one direction. With each step the needle sews perpendicularly along the buttonhole location. Once the needle reaches an end of the buttonhole position, the feed stops, and long tacking stitches are sewn in the cloth, and the feed moves the plate in steps in the opposite direction. A second row of stitches is sewn along the second side. When the opposite end of the buttonhole location is reached, the plate again stops and a tacking stitch is applied by the needle. The feed mechanism is effective at speeds of up to 4,000 RPMs, thus making it compatible with industrial sewing machines.

The simple, compact design of the feeding mechanism makes the present invention low maintenance and easily accessible. The feeding mechanism is a combination of shafts and gears driven by a ratchet mechanism for moving a plate. While power is applied to the sewing machine through the clutch a clamp is lowered, securing a shirt to a moveable plate and clutching a V belt drive to a main drive shaft. A main control cam starts turning, driven slowly by a worm gear on the drive shaft in the base of the machine. A back and forth movement by a double cam and double follower turns a feed shaft in step by step movements.

The feed shaft is positioned beneath the base of the sewing machine. The feed shaft rotates in steps, turning a pair of bevel gears keyed to the feed shaft consistently in steps in a constant direction. The feed shaft slides to the left or right, bringing one of the bevel gears into driving contact with a bevelled lower driving gear. When the shaft is in a centered position, neither bevel gears engage the lower driving gear. The lower driving gear is connected to a stub shaft that extends vertically through the base of the machine. An upper driving gear is connected to the opposite end of the stub shaft, above the base. When the lower driving gear is engaged by a bevel gear, the stub shaft, along with the upper driving gear, rotates. The upper driving gear engages a large gear having a pinion axially connected to the top of the large gear. The pinion rotates with the large gear and engages the edge of a rack of the plate, moving the plate in step increments.

In a standard operation, the feed shaft moves to the right, engaging a first bevel gear with the lower driving gear. The plate moves in a constant step by step motion to the right. As the plate moves, a needle extending over the fabric sews bight stitches along one side of the buttonhole. The shaft then moves to the center position so that neither bevel gear engages the lower driving gear. When the feed shaft moves to the center, the plate stops moving and long tacking stitches are sewn across an end of the buttonhole. Next, the shaft moves to the left, and the second bevel gear engages the lower driving gear. The plate moves in the opposite direction, and bight stitches are applied on the opposite side of the buttonhole. Finally, the feed shaft rests again in the center, stopping the plate and permitting long tacking stitches to be applied to the opposite end of the buttonhole.

The components of the present invention can be incorporated into a unit attached to the under side of the base. If the feed mechanism needs to be replaced, the entire unit can be removed, a new unit inserted, and the removed unit can be reconditioned at a remote location. The sewing machine is out of service for only brief periods, and is not dependent on in-house maintenance.

The operator of an industrial sewing machine having the feeding mechanism has minimal involvement. The operator positions the shirt on the tray and presses down on a pedal. The feeding mechanism clamps the shirt, starts the machine, stitches the buttonhole, lances the buttonhole, stops the machine and releases the shirt when the task is completed. The operator then need only reposition the shirt and repeat the process.

These and further and other objects and features of the invention are apparent in the disclosure, which includes the above and ongoing written specification, with the claims and the drawings.

DETAILED DESCRIPTION OF TEE PREFERRED EMBODIMENTS

Figure 1:
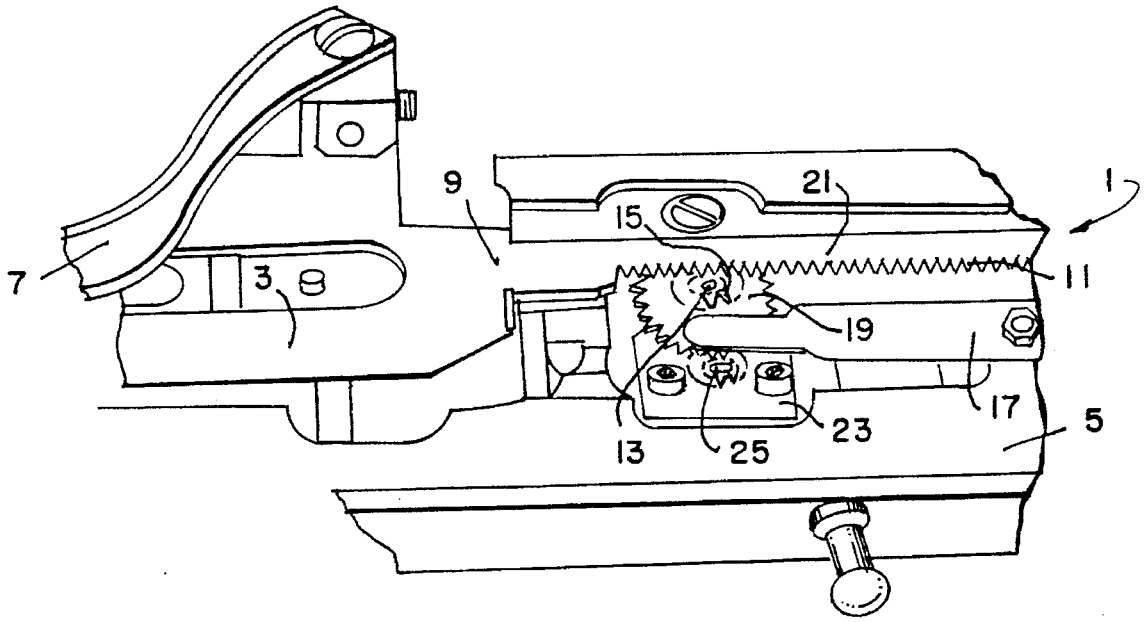
FIG. 1 is an overhead view of a feed mechanism mounted in a base of a sewing machine.
Figure 6:
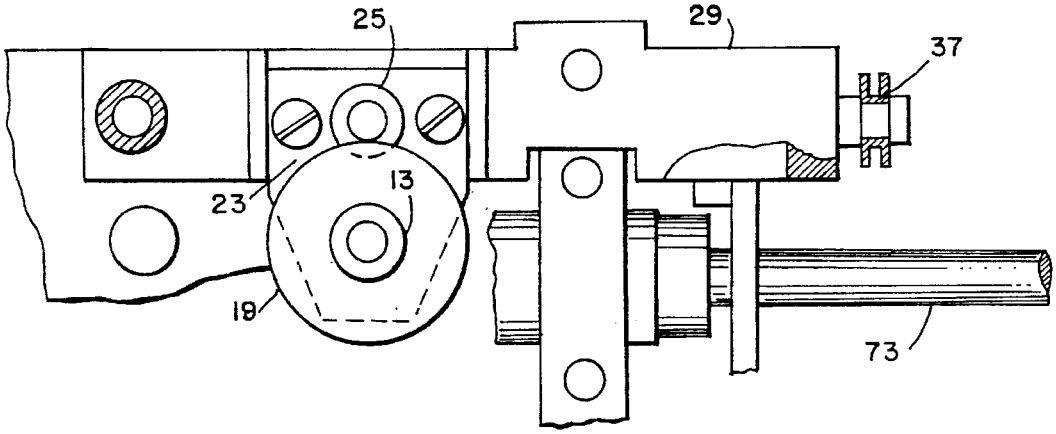
FIG. 6 is an overhead diagram of the present invention.

Referring to the drawings and to FIGS. 1 and 6, a combination of gears and shafts is used to move a plate 3 in a step-by-step manner. The plate 3 is flat and lies parallel to the base 5 of the sewing machine. A preferred embodiment has a plate 3 having a tray portion 7, and a rearward extension 9. The rearward extension 9 has rack teeth 11 which engage the edges of a pinion 13 for moving the plate 3 to the left or right. The teeth in the rack 11 are positioned at equidistant intervals corresponding to the teeth 15 of the pinion 13. Preferred embodiments of the present invention have a rack 21 as a continuous extension of the tray 7. A clamp 17 is connected to the base 5 of the sewing machine for securing a shirt to the plate 3 before stitching.

A combination of gears and shafts works to move the plate 3 bi-directionally. A pinion 13 is connected to the center of a large gear 19. The pinion 13 lies in the same parallel plane as the rack 21 of the plate 3. The large gear 19 is connected to a support 23 so as to permit clockwise and counterclockwise rotation. The rotation of the pinion 13 is dependent on the rotation of the large gear 19, and the pinion 13 and large gear 19 turn in the same direction. An upper driving gear 25 is attached to the support 23 in the same parallel plane as the large gear 19. The upper driving gear 25 is positioned near the large gear 19 so that the upper driving gear 25 teeth engage the edge of the large gear 19. When the upper driving gear 25 is rotated in a clockwise direction, the large gear 19 and the pinion 13 rotate in the counterclockwise direction.

Figure 4:
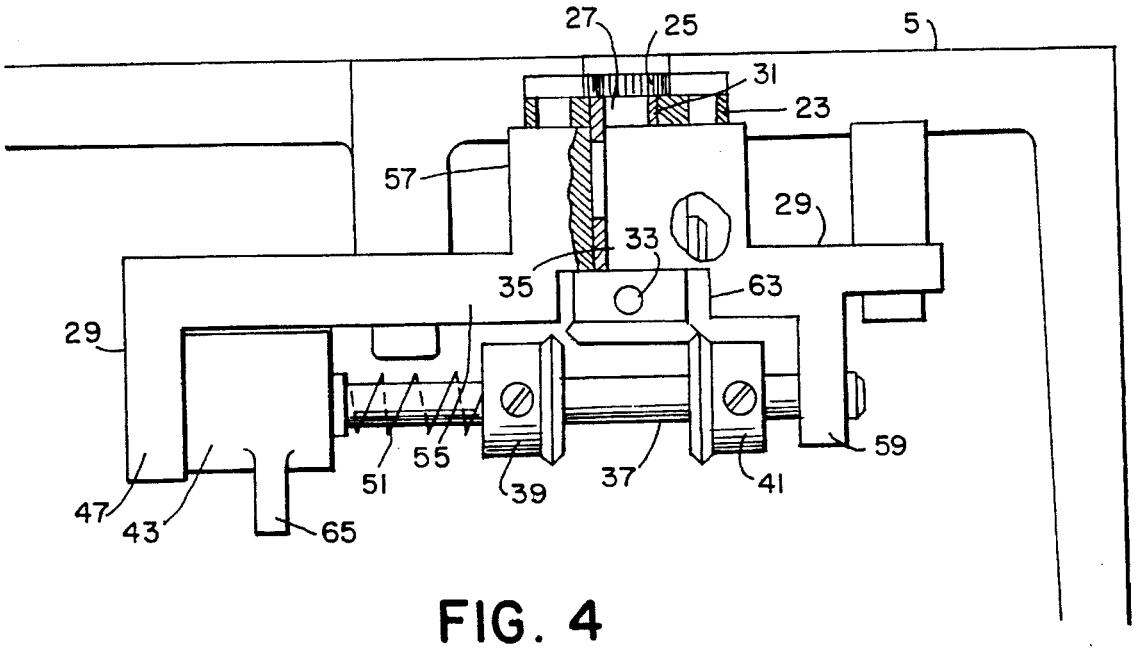
FIG. 4 shows a frontal view of the feed mechanism positioned in the base of a sewing machine.
Figure 5:
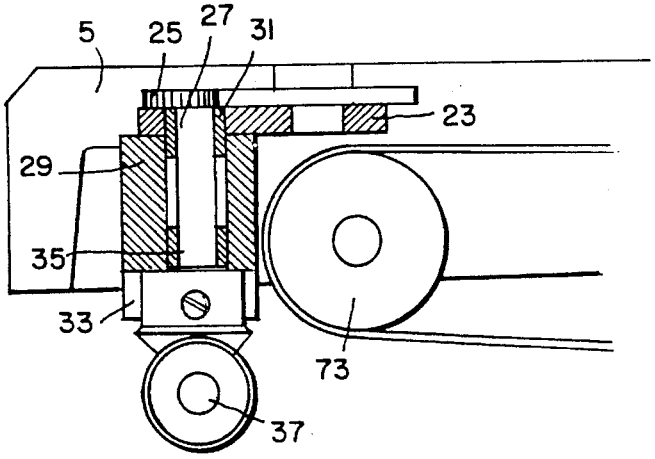
FIG. 5 is a cross-sectional side view of the feed mechanism.

The upper driving gear 25 is mounted on a stub shaft 27 as shown in FIGS. 4 and 5. The stub shaft 27 extends vertically through the support 23 and the holder 29 that attaches the feed mechanism 1 to the base 5 of the sewing machine. Onto the upper end 31 of the stub shaft 27 is mounted the upper driving gear 25. A lower driving gear 33 is mounted to the lower end 35 of the stub shaft 27. Both driving gears 25, 33 and the stub shaft 27 rotate in the same direction.

Figure 2:
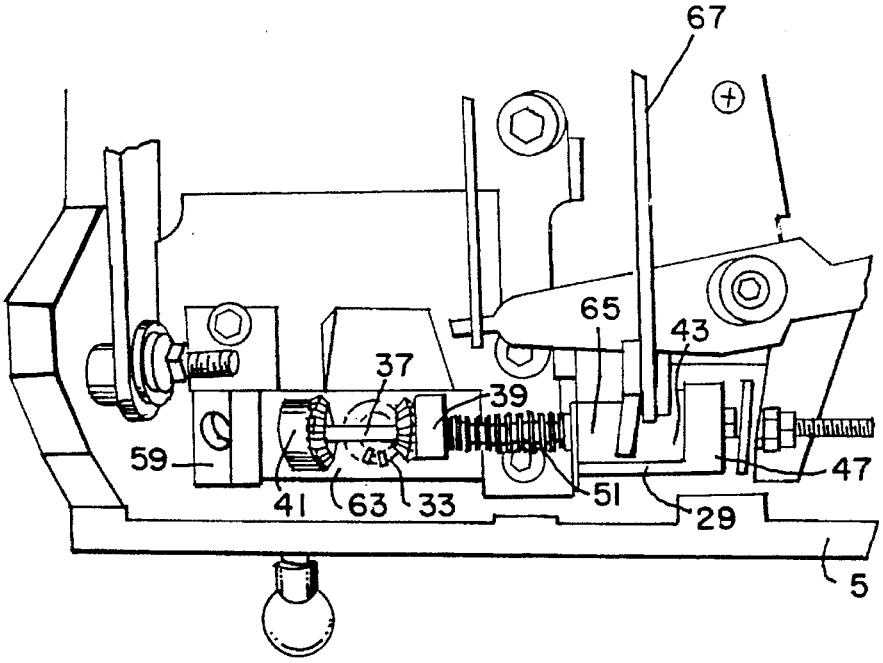
FIG. 2 is a view from the underside of the feed mechanism mounted in the base by a holder.
Figure 3:
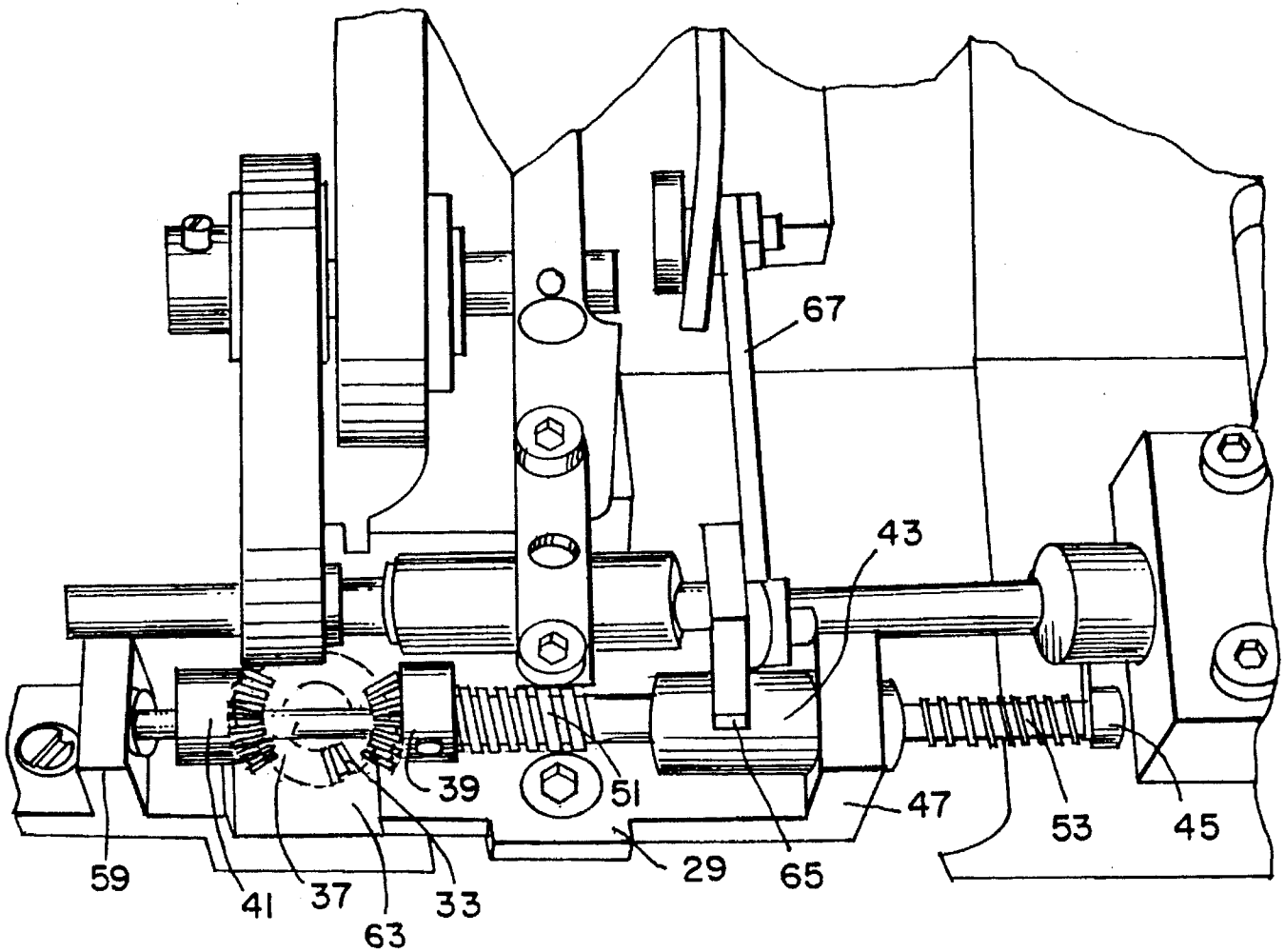
FIG. 3 shows the feed mechanism wherein the feed shaft extends beyond the right side of the holder and a coil spring lies between the end of the feed shaft and the holder sidewall.

FIGS. 2, 3 and 4 show the components of the feed mechanism 1 that are only visible from the underside of the base 5 of the sewing machine. A long, horizontal feed shaft 37 extends longitudinally under the base 5 of the sewing machine. The feed shaft 37 at its opposite ends is positioned in a holder 29 that is connected to the base 5 of the sewing machine. A left bevel gear 39 and a right bevel gear 41 are keyed to the feed shaft 37. The edges of the bevel gears 39, 41 face each other. The bevel gears 39, 41 are positioned on the feed shaft 37 a distance apart greater than the diameter of the lower driving gear 33. The feed shaft 37 lies below the lower driving gear 33 such that the edges of the bevel gears 39, 41 can engage the edge of the lower driving gear 33 when the feed shaft 37 is moved left or right. A cylinder 43 is positioned around the feed shaft 37 near its left end 45 between the left bevel gear 39 and the left sidewall 47 of the holder 29. The cylinder 43 is connected to a ratchet mechanism 49 that drives the feed shaft 37 and the gears. A preferred embodiment of the present invention is shown in FIGS. 2 and 4. A first spring 51 is coiled around the feed shaft 37 between the left bevel gear 39 and the cylinder 43 and the feed shaft 37 does not extend beyond the left sidewall 47 of the holder 29. A second embodiment of the feed mechanism 1 is shown in FIG. 3. The feed shaft 37 extends beyond the left sidewall 47 and a second spring 53 is coiled around the feed shaft 37 between the left sidewall 47 and the left end 45 of the feed shaft 37.

Preferred embodiments of the present invention have all the gears and shafts combined in one unit that can be easily removed from the base 5 of the sewing machine. One embodiment has a holder 29 as the connecting unit. The holder 29 has a bottom 55, a connecting segment 57, a left sidewall 47 and a right sidewall 59. The feed shaft 37 rests in openings 61 in the sidewalls 47, 59. The bottom 55 of the holder 29 has a well 61 in which the lower driving gear 33 is positioned. Extending upward from the bottom 55 toward the base 5 of the sewing machine is a connecting segment 57. The stub shaft 27 extends upward from the lower driving gear 33, out of the bottom 55 and through the connecting segment 57. Attached to the upper side if the connecting segment 57 of the holder 29 is a support 23. The stub shaft 27 ends at the support 23. The support 23 carries the upper driving gear 25, the large gear 19 and the pinion 13. The entire feed mechanism 1 is connected to the base 5 of the sewing machine by screws extending through the holder 29 to the base 5 of the sewing machine.

Figure 7:
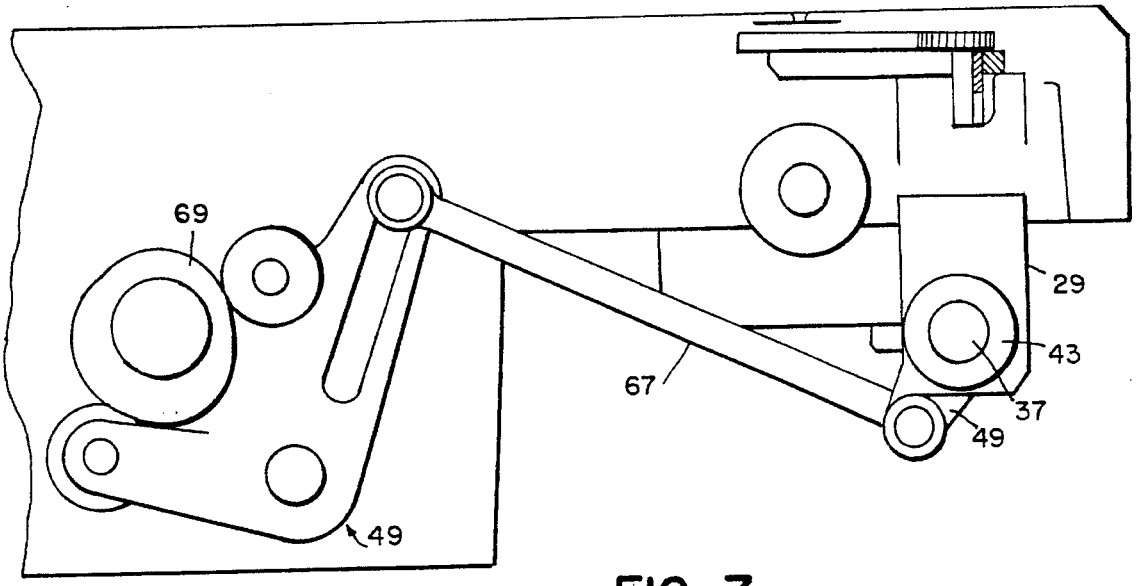
FIG. 7 is a side illustration of feed mechanism showing an embodiment of the ratchet mechanism that drives the feed shaft.

FIG. 7 shows a preferred embodiment of the ratchet mechanism 49 that drives the feed shaft 37 in small angular steps. The cylinder 43 connected to the feed shaft 37 has a short extension 65. The short extension 65 is connected to a long arm 67 that extends upward towards the base 5 of the sewing machine. When an operator presses down on the drive pedal, a main control cam 69 starts turning, driven slowly by a worm gear 71 on the drive shaft 73 of the base 5 of the sewing machine. A back and forth movement by a double cam causes the arm 67 to rock. This rotates the cylinder 43 and the feed shaft 37, thus driving the feed mechanism 1.

When power is applied through a clutch, the ratchet mechanism 49 turns the feed shaft 37 in steps. The feed shaft 37 turns the left bevel gear 39 and the right bevel gear 41 constantly in steps in a constant direction. The feed shaft 37 slides to either the left or the right, bringing either the left bevel gear 39 or the right bevel gear 41 into driving contact with the lower driving gear 33. The feed shaft 37 can also rest in a center position in which neither of the bevel gears 39, 41 contact the lower driving gear 33. The lower driving gear 33, when engaged by a bevel gear 39, 41, rotates. That rotation causes the stub shaft 27 and the upper driving gear 25 mounted to the upper end 31 of the stub shaft 27 to turn. The upper driving gear 25 drives the large gear 19. A pinion 13 is fixed to the center of the large gear 19 and rotates consistent with the rotation of the large gear 19. The rotating pinion 13 drives the rack 21 of the plate 3, moving the plate 3 left or right.

When the feed shaft 37 moves to the right, the left bevel gear 39 engages the lower driving gear 33, rotating the lower driving gear 33 and upper driving gear 25. The upper driving gear 25 engages the large gear 19, turning the large gear 19 and the pinion 13. The pinion 13 engages the rack 21, advancing the plate 3 to the right while a needle sews bights on one side of the buttonhole. Next, the feed shaft 37 moves to the center, disengaging the lower driving gear 33 from either bevel gear 39, 41. That disengagement stops plate 3 movement and allows for a tack to be sewn across an end of the buttonhole. The feed shaft 37 then moves to the left, engaging the right bevel gear 41 with the lower driving gear 33. Again, the upper driving gear 25 rotates, this time in the opposite direction as before. The large gear 19 is engaged by the upper driving gear 25, and the large gear 19 and pinion 13 turn. The rack 21 is engaged by the pinion 13, driving the plate 3 to the left and carrying the cloth thereon while the bights are stitched on the other side of the buttonhole. Finally, the feed shaft 37 moves to the center, the plate 3 is stopped, and a tack is sewn in the other end of the buttonhole.

While the invention has been described with reference to specific embodiments, modifications and variations of the invention may be constructed without departing from the scope of the invention, which is defined in the following claims.

We claim:

1. A work feed apparatus for a buttonhole sewing machine comprising a movable plate, a pinion that engages an edge of the plate, a large gear onto which is fixed the pinion, the large gear being connected to a support, an upper driving gear mounted on an upper end of a stub shaft, the upper driving gear lying in a same parallel plane as the large gear and positioned near the large gear so that an edge of the upper driving gear engages an edge of the large gear, and the stub shaft extending vertically downward, a lower driving gear mounted on a lower end of the stub shaft, a longitudinally shiftable feed shaft having a right end and a left end and extending perpendicular to the stub shaft beneath the lower driving gear, a left bevel gear and a right bevel gear, the left and right bevel gears keyed to the feed shaft and positioned on the feed shaft such that the lower driving gear is located between the left bevel gear and the right bevel gear, and a ratchet mechanism drivingly connected to the feed shaft for driving the feed shaft and for moving the plate in steps.

2. The apparatus of claim 1, wherein the plate has a tray and a rearward extension, the rearward extension having a row of teeth for engaging an edge of a pinion.

3. The apparatus of claim 2, wherein the rearward extension is a long, thin rack having a continuous row of teeth extending along a side of the rack for engaging the edge of the pinion.

4. The apparatus of claim 1, wherein the left bevel gear and the right bevel gear are keyed to the feed shaft near the right end of the shaft and the ratchet mechanism is connected to the feed shaft near the left end of the feed shaft.

5. The apparatus of claim 1, further comprising a holder for securing the feeding mechanism to a base of a sewing machine.

6. The apparatus of claim 5, wherein the holder has a bottom, a connecting segment extending upward from the bottom for joining the holder to the base of a sewing machine and onto which is secured the support, and a left sidewall and a right sidewall, extending downward from opposite sides of the base, the right sidewall and the left sidewall each having an opening for receiving an end of the feed shaft.

7. The apparatus of claim 6, wherein the holder further comprises a well opening downward into which is positioned the lower driving gear, and wherein the stub shaft extends through the holder.

8. The apparatus of claim 1 wherein the ratchet mechanism further comprises a cylinder through which the feed shaft is extended, a short extension connected to the cylinder, and an arm extending from the short extension to a driving mechanism.

9. The apparatus of claim 8, further comprising a first spring coiled around the feed shaft, the first spring positioned around the feed shaft between the left bevel gear and the cylinder.

10. The apparatus of claim 9, further comprising a second spring coiled around the feed shaft, the second spring positioned around the feed shaft between the cylinder and a left end of the feed shaft.

11. The apparatus of claim 8, wherein the driving mechanism further comprises a main control cam and a worm gear on a drive shaft for driving and turning the main control cam.

12. The apparatus of claim 1, further comprising a clamp connected to the upper side of the base for securing a piece of cloth to the plate.

13. The apparatus of claim 12, wherein the clamp is rotatably connected to the upper side of the base.

14. A feed mechanism for a sewing machine comprising a movable plate having a tray portion and a rearward extension, a rack formed on the rearward extension of the plate, a pinion that engages the rack and is fixed to a large gear, the large gear attached to a support, a vertical stub shaft that extends through the support and a holder, the stub shaft having a top end that extends above the holder and a lower end that extends below the holder, an upper driving gear mounted to the top end of the stub shaft for engaging the large gear, a lower driving gear mounted to the lower end of the stub shaft, a longitudinally shiftable feed shaft having a right end and a left end and extending perpendicular to and beneath the stub shaft, a left bevel gear and a right bevel gear, the right and left bevel gears keyed to the horizontal feed shaft and positioned such that the lower driving gear is located between the left and right bevel gears, a ratchet mechanism connected to the horizontal shaft for driving the horizontal shaft in steps, the ratchet mechanism having a cylinder mounted on the feed shaft near the left end, a short extension extending upward from the cylinder toward a base of a sewing machine, and a long arm connected to the short extension and attached to a driving mechanism, and a holder, having a bottom, a connecting segment, a right sidewall and a left sidewall, the sidewalls extending downward from the bottom, the connecting segment extending upward from the bottom for connecting the holder to the base, an opening in both the left sidewall and the right sidewall for receiving the ends of the feed shaft, and a well in the bottom opening downward in which is positioned the lower driving gear.

15. A method for sewing a buttonhole in a material comprising placing the material on a plate positioned in a base of a sewing machine, activating the sewing machine, clamping a shirt to the plate, moving the plate in a constant step motion in a first direction, delivering a needle carrying thread up and down through the material as the plate moves, stopping the plate, sewing a first row of tacking stitches after the plate stops, moving the plate in a constant step motion in a second direction, the second direction having substantially parallel movement in a direction opposite that of the first direction, delivering a needle carrying thread up and down through the material as the plate moves in the second direction, stopping the plate, sewing a second row of tacking stitches after the plate stops, and releasing the plate.

16. The method of claim 15, wherein the activating step further comprises applying power to the sewing machine through a clutch.

17. The method of claim 15, wherein the activating step further comprises depressing a pedal.

18. The method of claim 15, wherein the steps of moving the plate further comprises clutching a V-belt drive to a main drive shaft, driving and turning a main control cam by a worm gear positioned on a drive shaft, rotating a feed shaft in steps, turning a pair of bevel gears keyed to the feed shaft, sliding the feed shaft in the first direction, bringing one bevel gear into driving contact with a bevelled lower driving gear that is connected to a stub shaft, rotating the stub shaft and an upper driving gear connected to the stub shaft, engaging a large gear with the upper driving gear, rotating the large gear, rotating a pinion axially mounted on the large gear, and engaging a rack of the plate with the pinion.

19. The method of claim 18, wherein the stopping steps further comprise moving the feed shaft to a center position such that neither bevel gear engages the lower driving gear.

20. A method for stitching buttonholes comprising the steps of clamping the cloth to a plate, driving a feed shaft, rotating in steps the feed shaft and a left bevel gear and a right bevel gear that are keyed to the feed shaft, sliding the feed shaft to the right, engaging the left bevel gear with a lower driving gear and turning the lower driving gear, a stub shaft and an upper driving gear, the upper driving gear engaging a large gear, turning both the large gear and a pinion fixed on the large gear, and engaging an extension of the plate with the pinion for advancing the plate to the right while a needle sews bights on one side of a buttonhole, moving the feed shaft to a center position, disengaging the lower driving gear from either bevel gear, thereby stopping all plate movement and permitting a tack stitch to be sewn, moving the feed shaft to the left, engaging the right bevel gear with the low driving gear and turning the lower driving gear, the stub shaft and the upper driving gear, the upper driving gear engaging a large gear, turning both the large gear and a pinion fixed on the large gear, and engaging the extension of the plate with the pinion for advancing the plate to the left while the needle sews bights on a second side of the buttonhole, and moving the feed shaft to the center position, disengaging the lower driving gear from either bevel gear, thereby stopping all plate movement and permitting a tack stitch to be sewn.

* * * * *